US009126314B1

(12) United States Patent
Chu

(10) Patent No.: US 9,126,314 B1
(45) Date of Patent: Sep. 8, 2015

(54) RATCHET TOOL HAVING QUICK DRIVING MECHANISM

(71) Applicant: Te Chen Chu, Taichung (TW)

(72) Inventor: Te Chen Chu, Taichung (TW)

( * ) Notice: Subject to any disclaimer, the term of this patent is extended or adjusted under 35 U.S.C. 154(b) by 1 day.

(21) Appl. No.: 14/244,067

(22) Filed: Apr. 3, 2014

(51) Int. Cl.

| | |
|---|---|
| ***B25B 17/02*** | (2006.01) |
| ***B25B 15/04*** | (2006.01) |
| ***B25B 17/00*** | (2006.01) |
| *B25B 13/46* | (2006.01) |

(52) U.S. Cl.
CPC ..... *B25B 17/02* (2013.01); *B25B 15/04* (2013.01); *B25B 17/00* (2013.01); *B25B 13/467* (2013.01)

(58) Field of Classification Search
CPC ..... B25B 17/00; B25B 13/467; B25B 17/02
USPC ..... 81/57.29, 57.31, 60–63.2
See application file for complete search history.

(56) References Cited

U.S. PATENT DOCUMENTS

| | | | | | |
|---|---|---|---|---|---|
| 4,545,268 | A * | 10/1985 | Stuckey | ..... | 81/57.31 |
| 5,520,073 | A * | 5/1996 | Bakula et al. | ..... | 81/63.1 |
| 5,863,159 | A * | 1/1999 | Lasko | ..... | 408/124 |
| 6,250,183 | B1 * | 6/2001 | Chiang | ..... | 81/63.2 |
| 6,311,584 | B1 | 11/2001 | Chu | | |
| 6,450,067 | B1 | 9/2002 | Liao | | |
| 6,935,211 | B2 | 8/2005 | Chen | | |
| 7,055,411 | B2 | 6/2006 | Huang | | |
| 7,066,054 | B2 * | 6/2006 | Liu | ..... | 81/58.4 |
| 7,121,168 | B2 * | 10/2006 | Shu | ..... | 81/60 |
| 7,181,996 | B1 | 2/2007 | Chu | | |
| 7,237,459 | B1 * | 7/2007 | Shiao | ..... | 81/62 |
| 7,267,033 | B1 | 9/2007 | Lai | | |
| 7,311,186 | B2 | 12/2007 | Liao | | |
| 7,987,745 | B2 * | 8/2011 | Gauthier et al. | ..... | 81/57.31 |
| 8,122,788 | B2 * | 2/2012 | Gauthier et al. | ..... | 81/57.31 |
| 8,443,699 | B2 * | 5/2013 | Ha | ..... | 81/57.31 |
| 8,820,194 | B2 * | 9/2014 | Gauthier et al. | ..... | 81/57.31 |
| 2013/0112048 | A1 * | 5/2013 | Lin | ..... | 81/63.1 |

* cited by examiner

*Primary Examiner* — Hadi Shakeri
*Assistant Examiner* — Danny Hong
(74) *Attorney, Agent, or Firm* — Charles E. Baxley

(57) ABSTRACT

A ratchet driving tool includes a driving shank secured to a base supporting element and having two non-circular engaging segments, a casing engaged onto the driving shank and the engaging segments and having a groove and a slot for engaging with engaging elements, two gears engaged onto the casing and around the engaging elements for allowing the engaging elements to be engaged between the gears and the engaging segments and for determining a driving direction of the driving shank by the casing and the gears, a housing is attached to the base supporting element, and a control ferrule is engaged with the one of the gears for rotating the gears and the driving shank with the engaging elements.

10 Claims, 5 Drawing Sheets

RATCHET TOOL HAVING QUICK DRIVING MECHANISM

BACKGROUND OF THE INVENTION

1. Field of the Invention

The present invention relates to a ratchet driving tool, and more particularly to a ratchet driving tool including an improved driving mechanism for selectively and quickly actuating or operating the ratchet driving tool to quickly engage with and to quickly rotate or drive the extension tools or fasteners or the like.

2. Description of the Prior Art

Typical ratchet driving tools comprise a ratchet mechanism for selectively engaging with the extension tools or fasteners or the like and for selectively rotating or driving the extension tools or fasteners or the like.

For example, U.S. Pat. No. 6,450,067 to Liao, U.S. Pat. No. 6,935,211 to Chen, U.S. Pat. No. 7,055,411 to Huang, and U.S. Pat. No. 7,311,186 to Liao disclose several of the typical ratchet driving tools each comprising a ratchet mechanism for engaging with the driving shank or stem and for selectively actuating or operating the ratchet driving tools to engage with and to rotate or drive the extension tools or fasteners or the like.

However, the typical ratchet driving tools may only be provided to engage with and to drive the extension tools or fasteners or the like, but may not be actuated or operated to quickly engage with and to rotate or drive the extension tools or fasteners.

U.S. Pat. No. 6,311,584 to Chu, U.S. Pat. No. 7,181,996 to Chu, and U.S. Pat. No. 7,267,033 to Lai disclose several other typical ratchet driving tools each also comprising a ratchet mechanism for selectively engaging with the driving shank or stem and for selectively actuating or operating the ratchet driving tools to engage with and to rotate or drive the extension tools or fasteners or the like, and an additional driving mechanism for selectively engaging with and for selectively actuating or operating the ratchet driving tools to engage with and to rotate or drive the extension tools or fasteners or the like.

However, the additional driving mechanisms for the typical ratchet driving tools may only be provided to engage with and to rotate or drive the extension tools or fasteners or the like, but may not be actuated or operated to quickly engage with and to rotate or drive the extension tools or fasteners or the like.

The present invention has arisen to mitigate and/or obviate the afore-described disadvantages of the conventional ratchet driving mechanisms for tools.

SUMMARY OF THE INVENTION

The primary objective of the present invention is to provide a ratchet driving tool including an improved driving mechanism for selectively and quickly actuating or operating the ratchet driving tool to quickly engage with and to quickly rotate or drive the extension tools or fasteners or the like.

In accordance with one aspect of the invention, there is provided a ratchet driving tool comprising a base supporting element including a bore formed therein, a driving shank including a first end portion engaged into the bore of the base supporting element and rotatably secured to the base supporting element for allowing the driving shank to be rotated relative to the base supporting element, the driving shank including a second end portion, and including a first engaging segment located closer to the first end portion, and a second engaging segment located closer to the second end portion of the driving shank, and the first and the second engaging segments each including a non-circular cross section, a casing including a compartment formed therein for rotatably receiving and engaging with the driving shank and for allowing the casing to be rotated relative to the driving shank, the casing being engaged onto and located around the first and the second engaging segments of the driving shank, and the casing including at least one groove formed therein and communicating with the compartment of the casing and aligned with the first engaging segment for receiving and engaging with a first engaging element which is engageable with the first engaging segment, and including at least one slot formed therein and communicating with the compartment of the casing and aligned with the second engaging segment for receiving and engaging with a second engaging element which is engageable with the second engaging segment, a first gear and a second gear each including a bore formed therein for rotatably engaging onto the casing and for being engaged onto and located around the first and the second engaging elements respectively for allowing the first and the second engaging elements to be selectively engaged between the first and the second gears and the first and the second engaging segments and for determining a driving direction of the driving shank by the casing and the first and the second gears, a housing attached to the base supporting element and including a chamber formed therein for receiving the first and the second gears and the casing and the driving shank, a gearing mechanism engaged between the first and the second gears, and a control ferrule rotatably engaged onto the housing and engaged with the second gear for selectively rotating the first and the second gears and for selectively rotating the driving shank with the first and the second engaging elements, and the first and the second gears being drivable by the gearing mechanism and the housing and the base supporting element in order to drive the driving shank with the first and the second engaging elements.

The gearing mechanism includes at least two bevel gears engaged into the chamber of the housing and rotatably attached to the housing with shafts and engaged with the first and the second gears. The bevel gears and the shafts are preferably equally spaced from each other.

The second gear includes a serrated portion provided thereon, and the control ferrule includes a serrated member formed thereon and engaged with the serrated portion of the second gear for allowing the second gear to be rotated by the control ferrule.

The base supporting element includes a non-circular anchor provided thereon, and the chamber of the housing includes a non-circular cross section for engaging with the non-circular anchor of the base supporting element and for preventing the housing from being rotated relative to the base supporting element.

The casing includes at least one engaging notch formed therein, and an actuating member is rotatably engaged onto the driving shank and includes at least one engaging key for engaging with the engaging notch of the casing and for allowing the casing and the first and the second engaging elements to be rotated relative to the driving shank with the actuating member.

The actuating member includes at least one engaging recess formed therein, and a sleeve is rotatably engaged onto the driving shank and includes at least one engaging projection extended therefrom for engaging with the engaging recess of the actuating member and for allowing the actuating member and the casing and the first and the second engaging elements to be rotated relative to the driving shank by the sleeve.

The actuating member includes two engaging depressions formed therein, and the driving shank includes a spring biased projection extendible out of the driving shank and engageable with either of the depressions of the actuating member for positioning the actuating member and thus the casing and the first and the second engaging elements to the driving shank at selected positions.

A handle may further be provided and attached to the base supporting element, and the base supporting element includes at least one fin extended therefrom and engaged with the handle for preventing the base supporting element from being rotated relative to the handle.

A tool member may further be provided and includes a cavity formed therein for engaging with the second end portion of the driving shank, and includes an engaging hole formed therein for engaging with a tool element.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
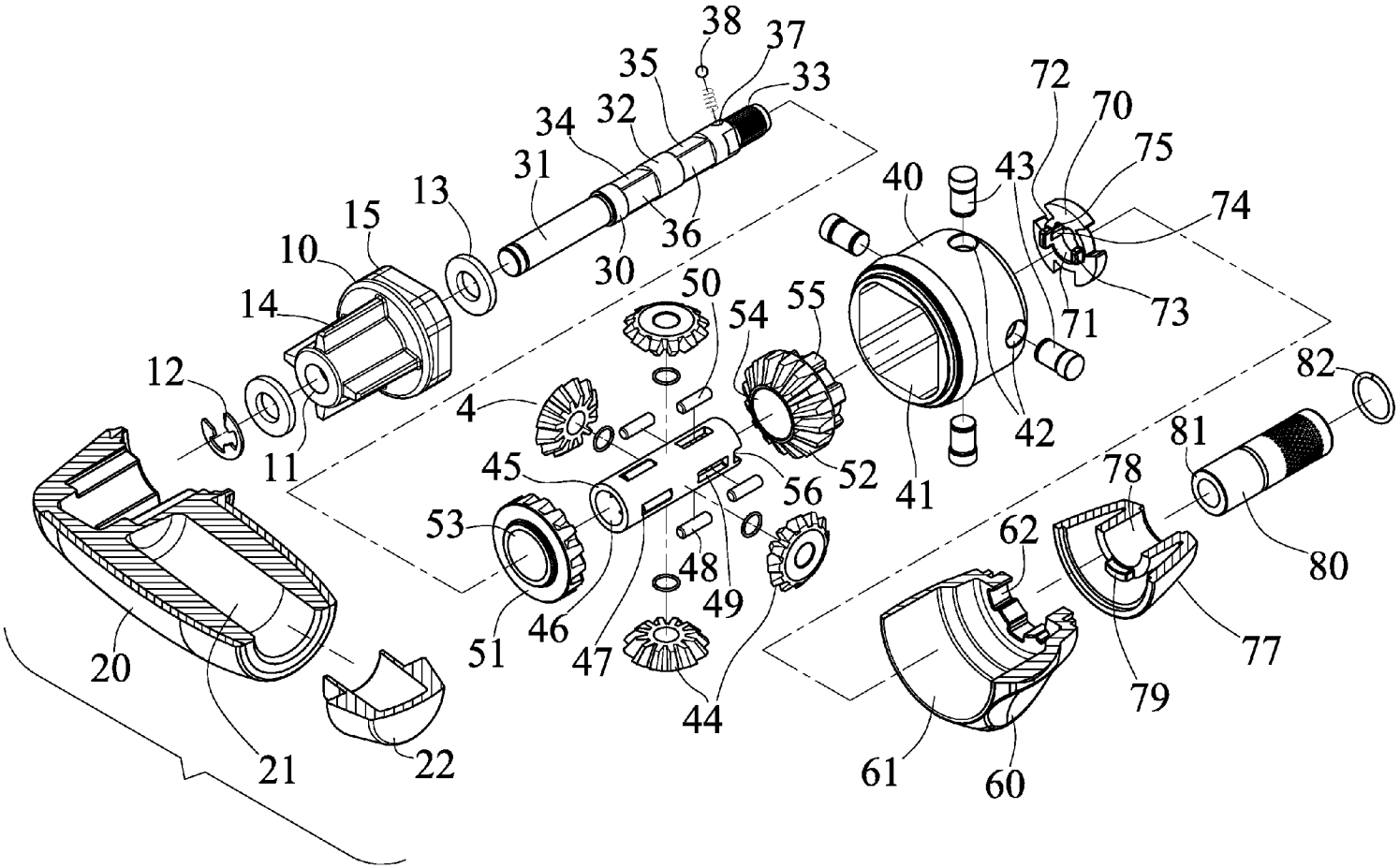
FIG. 1 is an exploded view of a ratchet driving tool in accordance with the present invention.
Figure 3:
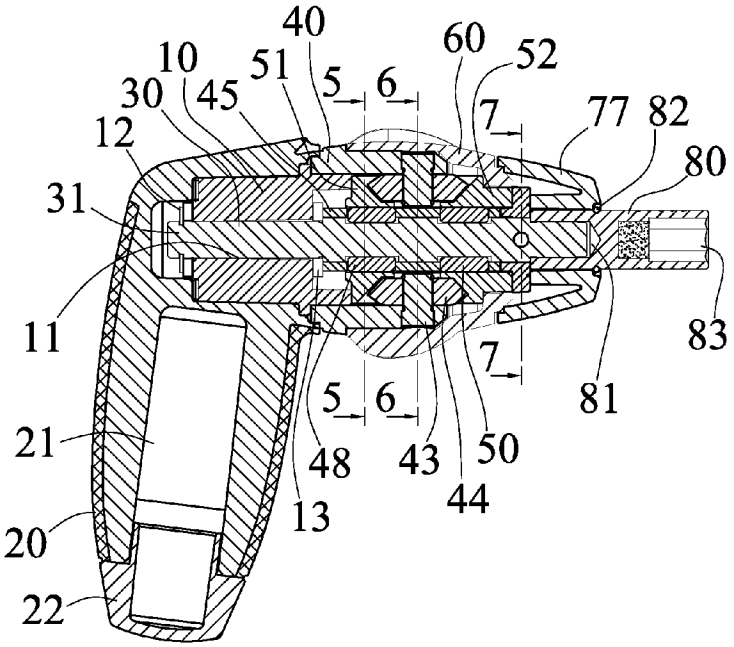
FIGS. 3, 4 are cross sectional views of the ratchet driving tool, taken along lines 3-3, 4-4 of FIG. 2 respectively.

Referring to the drawings, and initially to FIGS. 1-7, a ratchet driving tool in accordance with the present invention comprises a tool body or block or housing or base supporting element 10 including a chamber or compartment or bore 11 longitudinally formed therein for pivotally or rotatably receiving or engaging with a follower or driving shank 30, for example, the driving shank 30 includes an inner end portion or one or first end portion 31 pivotally or rotatably engaged into or with the bore 11 of the base supporting element 10 and pivotally or rotatably attached or mounted or secured to the base supporting element 10 with a clamping or retaining ring 12 and/or one or more washers 13 for allowing the driving shank 30 to be pivoted or rotated relative to the base supporting element 10, but the driving shank 30 may not be slid or moved relative to the base supporting element 10.

The ratchet driving tool may further include a hand grip or handle 20 for receiving or engaging with or for supporting the base supporting element 10, for example, the base supporting element 10 includes one or more ribs or protrusions or fins 14 extended radially and outwardly therefrom and fitted or engaged with or molded within the handle 20 for solidly and stably attaching or mounting or securing or coupling or anchoring or retaining the base supporting element 10 and the handle 20 together and for preventing the base supporting element 10 from being pivoted or rotated relative to the handle 20. The handle 20 may include one or more spaces or chambers or compartments 21 formed therein for receiving spare tool elements (not illustrated) or the like, and a cover 22 attached or mounted to the handle 20 for blocking or enclosing the compartments 21 of the handle 20.

Figure 2:
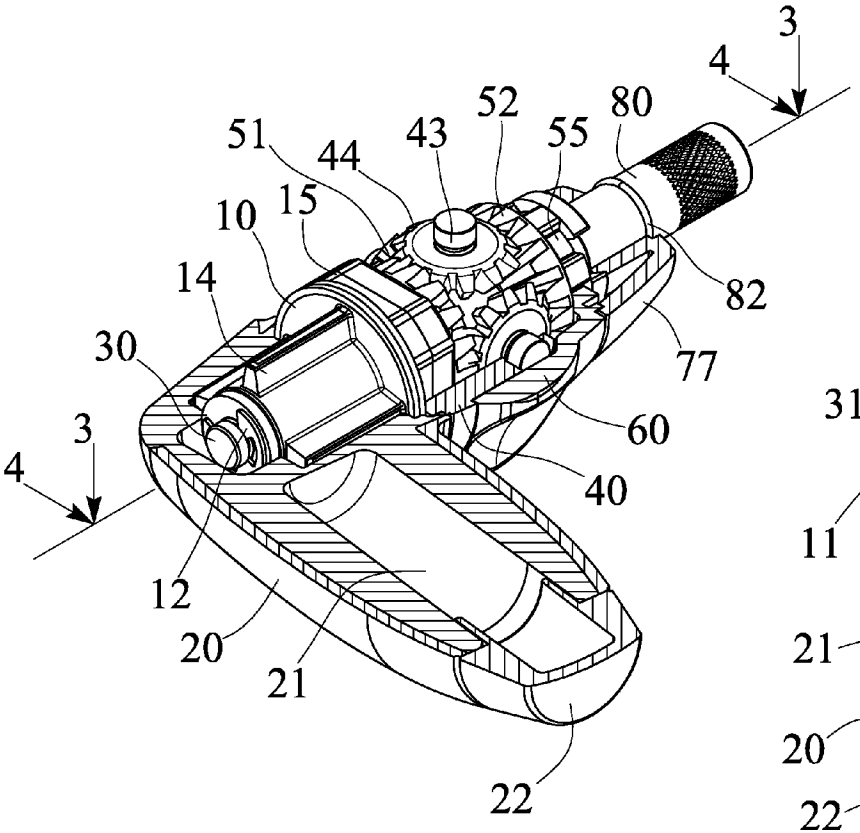
FIG. 2 is a perspective view of the ratchet driving tool, in which a portion of the ratchet driving tool has been cut off for showing the inner structure of the ratchet driving tool.
Figure 4:
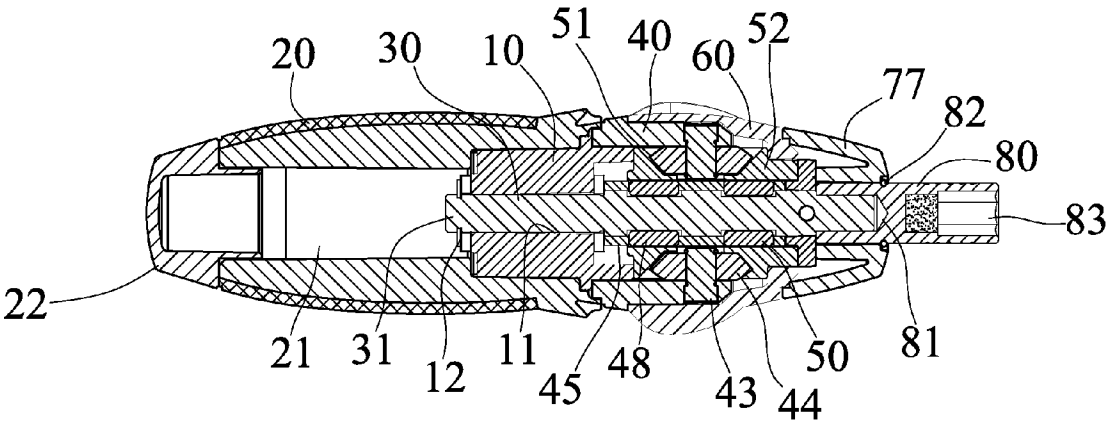
Figure 6:
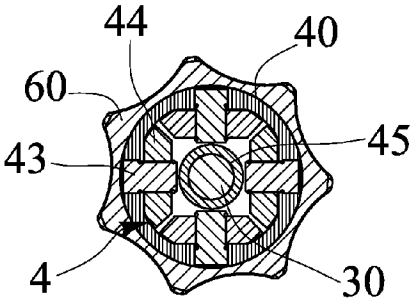
FIGS. 5, 6, 7 are cross sectional views of the ratchet driving tool, taken along lines 5-5, 6-6, and 7-7 of FIG. 3 respectively.

The base supporting element 10 further includes a non-circular block or protrusion or anchor 15 having a non-circular cross section, such as a rectangular or square cross section, formed or provided thereon or extended therefrom and extended or located outside the handle 20 (FIG. 2). A receptacle or housing 40 includes a space or compartment or chamber 41 formed therein and having a non-circular cross section, for receiving or engaging with the base supporting element 10, particularly the non-circular anchor 15 of the base supporting element 10 and for solidly and stably anchoring or retaining or positioning the housing 40 to the base supporting element 10 and for preventing the housing 40 from being pivoted or rotated relative to the base supporting element 10. The housing 40 may further be solidly and stably secured to the base supporting element 10 with latches or fasteners or locks (not illustrated), adhesives, welders or the like.

The housing 40 includes one or more (such as four) apertures or orifices 42 formed in the outer peripheral portion thereof and intersected or communicating with the chamber 41 of the housing 40, and one or more (such as four) rods or shafts 43 engaged into the orifices 42 of the housing 40 respectively and mounted or secured to the housing 40 with latches or fasteners or locks (not illustrated), force-fitted engagement, adhesives, welders or the like, and extended into the chamber 41 of the housing 40, and a gearing mechanism 4 having one or more (such as four) pinions or bevel gears 44 attached or mounted or secured to the shafts 43 respectively and extended into the chamber 41 of the housing 40 and rotated in concert with the shafts 43 relative to the housing 40. It is preferable that the shafts 43 and the bevel gears 44 are equally spaced from each other and freely rotatable relative to the housing 40.

The driving shank 30 includes a middle or intermediate portion 32 substantially extended into or through the chamber 41 of the housing 40 and located within the housing 40, and an outer or other or second end portion 33 extended out of the housing 40, and one or more (such as two) driving or engaging portions or segments 34, 35 formed or provided on the middle and/or the outer end portion 32, 33 of the driving shank 30 and spaced from each other, in which the first or rear engaging segment 34 is located closer to the inner or first end portion 31 of the driving shank 30 and the second or front engaging segment 35 is located closer to the outer or second end portion 33 of the driving shank 30, and the engaging segments 34, 35 each include a non-circular cross section, such as a triangular or rectangular or square cross section (FIG. 5) having one or more (such as four) cut off portions or flat or engaging surfaces 36 formed or provided therein.

A sleeve or barrel or tubular member or casing 45 is rotatably disposed or engaged onto the driving shank 30, such as the middle and/or the outer end portion 32, 33 of the driving shank 30 and disposed or engaged onto or located around the engaging segments 34, 35, and includes a chamber or bore or compartment 46 formed therein for rotatably receiving or engaging with the driving shank 30 and for allowing the casing 45 to be pivoted or rotated relative to the driving shank 30, and includes one or more (such as four) slots or grooves 47 formed in the rear portion thereof and communicating with the compartment 46 of the casing 45 and aligned with the engaging surfaces 36 of the first or rear engaging segment 34 respectively and each for pivotally or rotatably receiving or engaging with a roller or ball or first engaging element 48 which is contactable or engageable with the engaging surfaces 36 of the first or rear engaging segment 34 respectively.

The casing 45 further includes one or more (such as four) grooves or slots 49 formed in the front portion thereof (FIG. 1) and communicating with the compartment 46 of the casing 45 and aligned with the engaging surfaces 36 of the second or front engaging segment 35 respectively and each for pivotally or rotatably receiving or engaging with another roller or ball or engaging element 50 which is contactable or engageable with the engaging surfaces 36 of the second or front engaging segment 35 respectively, and the casing 45 may be pivoted or rotated relative to the driving shank 30 for moving or actuating the engaging elements 48, 50 toward or to engage with either side of the engaging surfaces 36 of the engaging segments 34, 35 (FIG. 5) and for determining the rotating or driving direction of the casing 45 by the driving shank 30.

A follower or pinion or bevel gear 51 and a driving or active pinion or bevel gear 52 each include a chamber or compartment or bore 53, 54 formed therein for pivotally or rotatably receiving or engaging with the casing 45, and to be disposed or engaged onto or located around the engaging elements 48, 50 respectively for allowing the engaging elements 48, 50 to be selectively engaged between the bevel gears 51, 52 and either side of the engaging surfaces 36 of the engaging segments 34, 35 (FIG. 5), and thus for allowing the rotating or driving direction of the casing 45 and the bevel gears 51, 52 by the driving shank 30, or the rotating or driving direction of the driving shank 30 by the bevel gears 51, 52 to be determined by the engagement of the engaging elements 48, 50 with either side of the engaging surfaces 36 of the engaging segments 34, 35.

Figure 5:
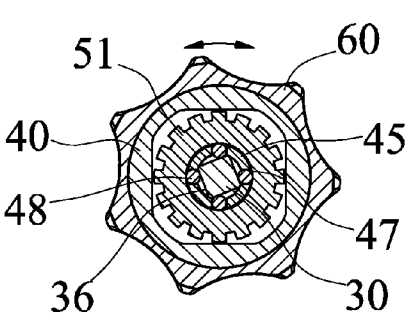
Figure 7:
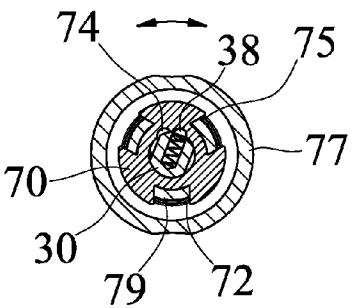

In operation, as shown in FIGS. 2-5, when the engaging elements 48, 50 are located at one side of the engaging surfaces 36 of the engaging segments 34, 35, as shown in FIG. 5, the driving shank 30 may be selectively rotated or driven clockwise by the bevel gears 51, 52, and may be selectively rotated or driven counterclockwise by the bevel gears 51, 52 when the engaging elements 48, 50 are located at the other side of the engaging surfaces 36 of the engaging segments 34, 35. The bevel gears 51, 52 are meshed or engaged with the bevel gears 44 of the gearing mechanism 4 for allowing the follower bevel gear 51 to be pivoted or rotated relative to the casing 45 with or by the driving or active bevel gear 52 and the bevel gears 44 of the gearing mechanism 4. The driving or active bevel gear 52 includes a number of teeth or a serrated portion or segment 55 formed or provided thereon.

Another tubular member or barrel or sleeve or control ferrule 60 is pivotally or rotatably engaged onto the housing 40 and the active bevel gear 52, and includes a compartment or chamber or space 61 formed therein for pivotally or rotatably receiving or engaging with the housing 40 and for solidly and stably anchoring or retaining or positioning the shafts 43 in the orifices 42 of the housing 40 respectively, and the control ferrule 60 includes a number of teeth or another serrated portion or member 62 formed or provided thereon and meshed or engaged with the serrated portion or segment 55 of the active bevel gear 52 for allowing the active bevel gear 52 to be selectively rotated or driven by the control ferrule 60, and thus for allowing the driving shank 30 to be selectively rotated or driven by the control ferrule 60 with the bevel gears 51, 52 and the bevel gears 44 of the gearing mechanism 4 and the engaging elements 48, 50.

It is to be noted that the bevel gears 44 of the gearing mechanism 4 are not meshed or engaged with each other (FIG. 6), but meshed or engaged with or between the bevel gears 51, 52 (FIGS. 2-4) for allowing the follower bevel gear 51 to be pivoted or rotated relative to the casing 45 with or by the driving or active bevel gear 52 and the bevel gears 44 of the gearing mechanism 4, and thus for allowing the driving shank 30 to be selectively and quickly rotated or driven by the control ferrule 60 with the bevel gears 51, 52 and the bevel gears 44 of the gearing mechanism 4 and the engaging elements 48, 50. At this moment, the housing 40 is solidly and stably anchored or retained or positioned to the base supporting element 10 and the handle 20, and the driving shank 30 is pivotable or rotatable relative to the housing 40 and the base supporting element 10 and the handle 20.

The casing 45 further includes one or more engaging members or notches 56 formed therein (FIG. 1), and an operating or actuating ring or member 70 includes a chamber or compartment or bore 71 formed therein for pivotally or rotatably receiving or engaging with the driving shank 30 and for allowing the actuating member 70 to be pivoted or rotated relative to the driving shank 30, and includes one or more engaging notches or recesses 72 formed in the outer peripheral portion thereof, and includes one or more engaging ears or flaps or projections or keys 73 extended axially therefrom for engaging with the engaging notches 56 of the casing 45 and for allowing the casing 45 and the engaging elements 48, 50 to be pivoted or rotated relative to the driving shank 30 with the actuating member 70, and thus for allowing the engaging elements 48, 50 to be selectively engaged with either side of the engaging surfaces 36 of the engaging segments 34, 35.

The actuating member 70 includes one or more (such as two) engaging depressions 74, 75 formed therein (FIGS. 1, 7) and communicating with the bore 71 of the actuating member 70, and the driving shank 30 includes a cavity 37 formed in the other or outer or second end portion 33 thereof for receiving or engaging with a spring biased projection 38 which is extendible out of the driving shank 30 and which is engageable with either of the depressions 74, 75 of the actuating member 70 in order to anchor or retain or position the actuating member 70 and thus the casing 45 and the engaging elements 48, 50 to the driving shank 30 at the selected angular position, and thus to anchor or retain or position the engaging elements 48, 50 at the selected side of the engaging surfaces 36 of the engaging segments 34, 35.

A further tubular member or barrel or control ferrule or sleeve 77 is pivotally or rotatably engaged onto the driving shank 30, and includes a bore 78 formed therein for pivotally or rotatably receiving or engaging with the driving shank 30 and for allowing the sleeve 77 to be pivoted or rotated relative to the driving shank 30, and includes one or more engaging ears or flaps or keys or projections 79 extended axially therefrom for engaging with the engaging recesses 72 of the actuating member 70 and for allowing the actuating member 70 and thus the casing 45 and the engaging elements 48, 50 to be pivoted or rotated relative to the driving shank 30 by or with the sleeve 77 and thus for switching or changing the rotating or driving direction of the driving shank 30 by the bevel gears 51, 52.

Figure 9:
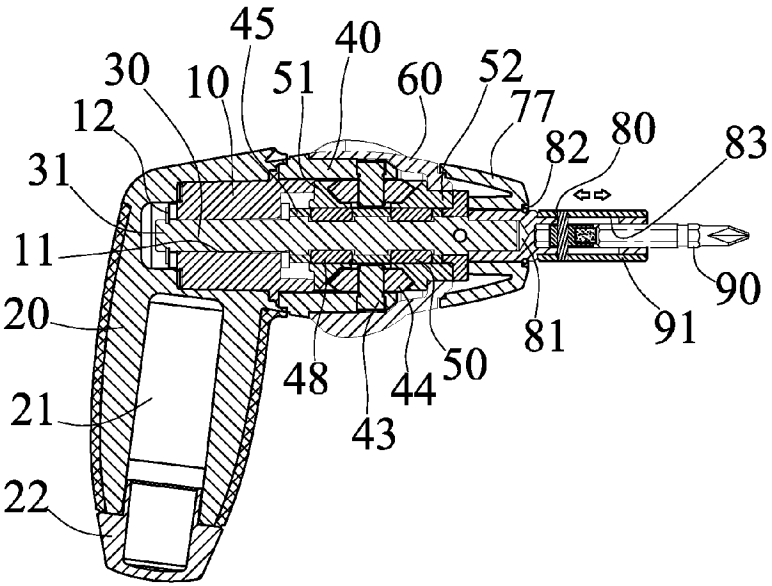
FIGS. 8, 9 are cross sectional views similar to FIG. 3, illustrating the operation of the ratchet driving tool.
Figure 8:
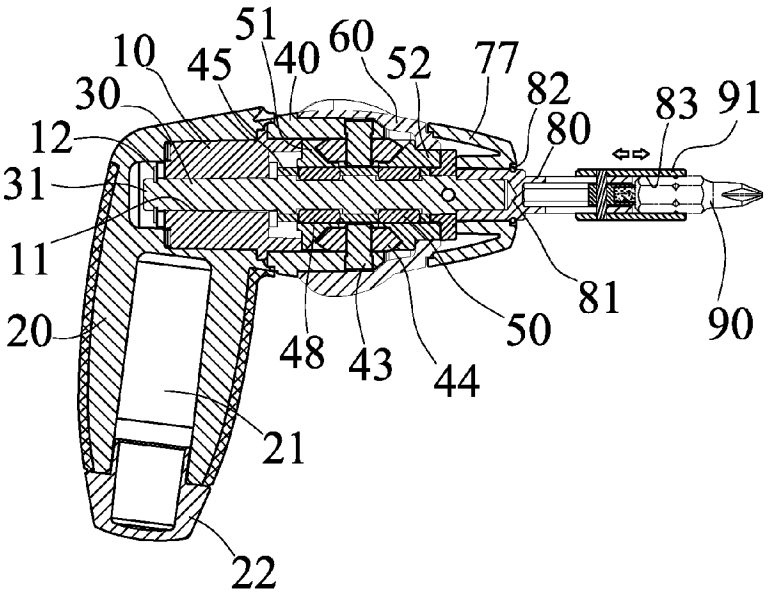
Figure 11:
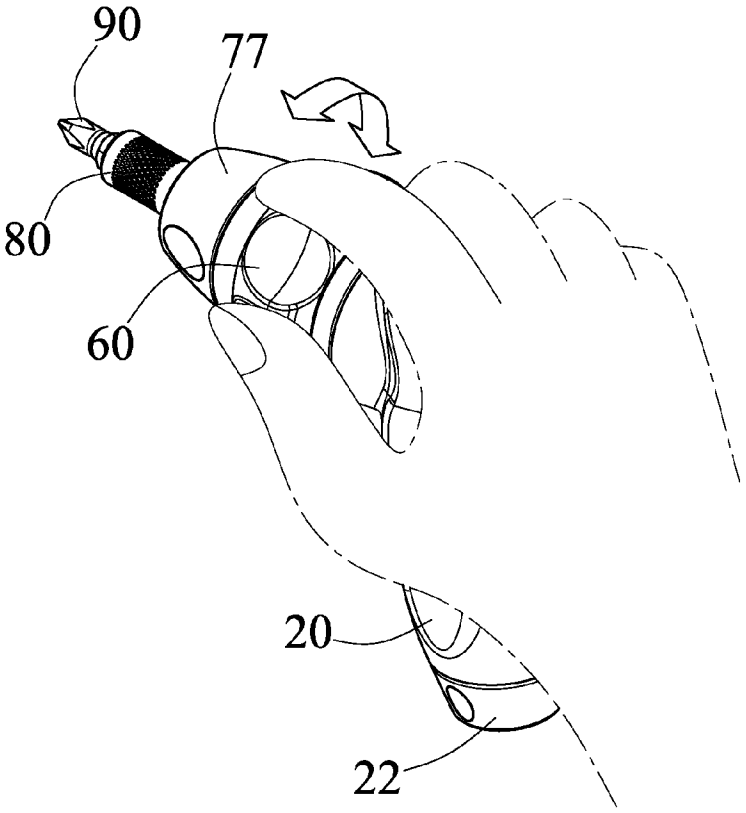
FIGS. 10, 11 are perspective views illustrating the operation of the ratchet driving tool.
Figure 10:
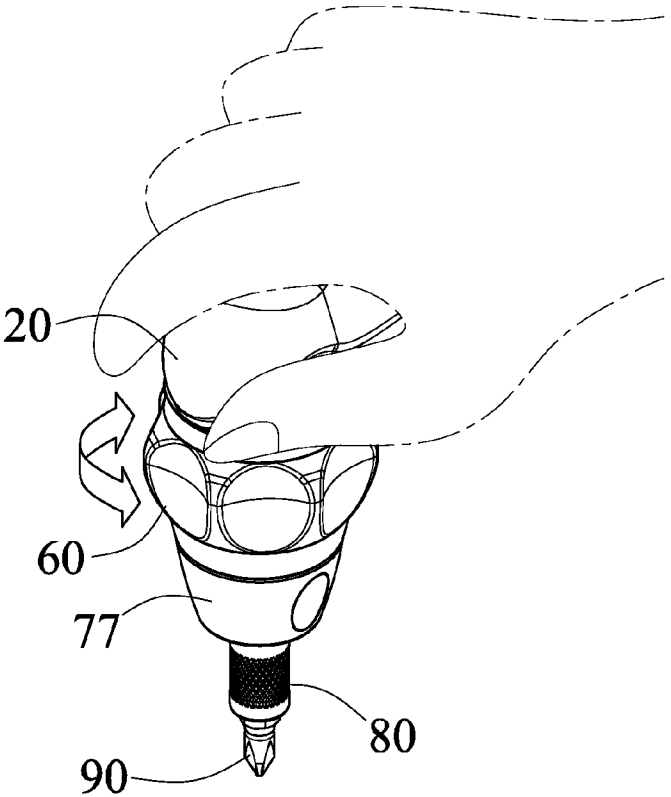

An adapter or tool extension or socket or tool member 80 includes a cavity 81 formed in one end portion thereof for receiving or engaging with the other or outer or second end portion 33 of the driving shank 30 and solidly and stably attached or mounted or secured to the driving shank 30 with latches or fasteners or locks (not illustrated), force-fitted engagement, adhesives, welders or the like, and includes a clamping or retaining ring 82 attached or mounted or secured thereon and contacted or engaged with the sleeve 77 for solidly and stably attaching or mounting or securing or coupling or anchoring or retaining the sleeve 77 to the tool member 80 and the driving shank 30, and includes an engaging hole 83 formed therein (FIGS. 3-4, 8-9) for receiving or engaging with another tool member or fastener or tool bit or tool element 90 (FIGS. 8-11) which may be selectively moved or adjusted toward or away from the driving shank 30 (FIGS. 8-9).

In operation, as shown in FIGS. 8 and 9, when the tool element 90 is attached to or engaged with the other or outer or second end portion 33 of the driving shank 30 or with the tool member 80 for engaging with the tool member or fastener (not illustrated) to be selectively rotated or driven by the ratchet driving tool in accordance with the present invention, the control ferrule 60 may be selectively rotated or driven by the user, relative to the base supporting element 10 and the handle 20, the driving or active bevel gear 52 may be selectively rotated or driven by the control ferrule 60, and thus the follower bevel gear 51 may be rotated or driven relative to the driving shank 30 with the bevel gears 44 of the gearing mechanism 4, and the driving shank 30 and the tool element 90 may thus be selectively and quickly rotated or driven by the bevel gears 51, 52 and the engaging elements 48, 50 in either direction.

The sleeve 77 may be selectively rotated or driven relative to the base supporting element 10 and the handle 20 and the driving shank 30 in order to rotate the actuating member 70 and the casing 45 relative to the driving shank 30 and to move or actuate the engaging elements 48, 50 to engage with either side of the engaging surfaces 36 of the engaging segments 34, 35 (FIG. 5) and to determine the rotating or driving direction of the driving shank 30 by the casing 45 and the bevel gears 51, 52. When the handle 20 and the base supporting element 10 are rotated or driven by the user (FIG. 11), the housing 40 and thus the bevel gears 44 of the gearing mechanism 4 and the bevel gears 51, 52 may also be rotated or driven by the handle 20, and the driving shank 30 may thus be selectively rotated or driven by the bevel gears 51, 52 with the engaging elements 48, 50 in a greater torque.

Accordingly, the ratchet driving tool includes an improved driving mechanism for selectively and quickly actuating or operating the ratchet driving tool to quickly engage with and to quickly rotate or drive the extension tools or fasteners or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet driving tool comprising:

a base supporting element including a bore formed therein, a driving shank including a first end portion engaged into said bore of said base supporting element and rotatably secured to said base supporting element for allowing said driving shank to be rotated relative to said base supporting element, said driving shank including a second end portion, and including a first engaging segment located closer to said first end portion, and a second engaging segment located closer to said second end portion of said driving shank, and said first and said second engaging segments each including a non-circular cross section, a casing including a compartment formed therein for rotatably receiving and engaging with said driving shank and for allowing said casing to be rotated relative to said driving shank, said casing being engaged onto and located around said first and said second engaging segments of said driving shank, and said casing including at least one groove formed therein and communicating with said compartment of said casing and aligned with said first engaging segment for receiving and engaging with a first engaging element which is engageable with said first engaging segment, and including at least one slot formed therein and communicating with said compartment of said casing and aligned with said second engaging segment for receiving and engaging with a second engaging element which is engageable with said second engaging segment, a first gear and a second gear each including a bore formed therein for rotatably engaging onto said casing and for being engaged onto and located around said first and said second engaging elements respectively for allowing said first and said second engaging elements to be selectively engaged between said first and said second gears and said first and said second engaging segments and for determining a driving direction of said driving shank by said casing and said first and said second gears, a housing attached to said base supporting element and including a chamber formed therein for receiving said first and said second gears and said casing and said driving shank, a gearing mechanism engaged between said first and said second gears, and a control ferrule rotatably engaged onto said housing and engaged with said second gear for selectively rotating said first and said second gears and for selectively rotating said driving shank with said first and said second engaging elements, and said first and said second gears being drivable by said gearing mechanism and said housing and said base supporting element in order to drive said driving shank with said first and said second engaging elements.

2. The ratchet driving tool as claimed in claim 1, wherein said gearing mechanism includes at least two bevel gears engaged into said chamber of said housing and rotatably attached to said housing with shafts and engaged with said first and said second gears.

3. The ratchet driving tool as claimed in claim 2, wherein said at least two bevel gears and said shafts are equally spaced from each other.

4. The ratchet driving tool as claimed in claim 1, wherein said second gear includes a serrated portion provided thereon, and said control ferrule includes a serrated member formed thereon and engaged with said serrated portion of said second gear for allowing said second gear to be rotated by said control ferrule.

5. The ratchet driving tool as claimed in claim 1, wherein said base supporting element includes a non-circular anchor provided thereon, and said chamber of said housing includes a non-circular cross section for engaging with said non-circular anchor of said base supporting element and for preventing said housing from being rotated relative to said base supporting element.

6. The ratchet driving tool as claimed in claim 1, wherein said casing includes at least one engaging notch formed therein, and an actuating member is rotatably engaged onto said driving shank and includes at least one engaging key for engaging with said at least one engaging notch of said casing and for allowing said casing and said first and said second engaging elements to be rotated relative to said driving shank with said actuating member.

7. The ratchet driving tool as claimed in claim 6, wherein said actuating member includes at least one engaging recess formed therein, and a sleeve is rotatably engaged onto said driving shank and includes at least one engaging projection extended therefrom for engaging with said at least one engaging recess of said actuating member and for allowing said actuating member and said casing and said first and said second engaging elements to be rotated relative to said driving shank by said sleeve.

8. The ratchet driving tool as claimed in claim 6, wherein said actuating member includes two engaging depressions formed therein, and said driving shank includes a spring biased projection extendible out of said driving shank and engageable with either of said depressions of said actuating member for positioning said actuating member and thus said casing and said first and said second engaging elements to said driving shank at selected positions.

9. The ratchet driving tool as claimed in claim 1 further comprising a handle attached to said base supporting element, and said base supporting element includes at least one fin extended therefrom and engaged with said handle for preventing said base supporting element from being rotated relative to said handle.

10. The ratchet driving tool as claimed in claim 1 further comprising a tool member including a cavity formed therein for engaging with said second end portion of said driving shank, and includes an engaging hole formed therein for engaging with a tool element.

* * * * *